United States Patent [19]

Wood

[11] Patent Number: 4,966,013

[45] Date of Patent: Oct. 30, 1990

[54] METHOD AND APPARATUS FOR PREVENTING COMPRESSOR FAILURE DUE TO LOSS OF LUBRICANT

[75] Inventor: Russell E. Wood, Fayetteville, N.Y.

[73] Assignee: Carrier Corporation, Syracuse, N.Y.

[21] Appl. No.: 395,874

[22] Filed: Aug. 18, 1989

[51] Int. Cl.[5] ..... F25B 49/02

[52] U.S. Cl. ..... 62/193; 62/126; 62/129; 62/228.3

[58] Field of Search ..... 62/126, 127, 129, 157, 62/158, 203, 204, 205, 192, 193, 226, 228.1, 228.3, 231

[56] References Cited

U.S. PATENT DOCUMENTS 1,425,265 8/1922 Marshall ..... 62/204
4,463,573 8/1984 Zeno et al. ..... 62/157
4,677,830 7/1987 Sumikawa et al. ..... 62/126

FOREIGN PATENT DOCUMENTS 0077414 4/1983 European Pat. Off. ..... 62/190

*Primary Examiner*—Harry B. Tanner
*Attorney, Agent, or Firm*—David J. Zobkiw

[57] ABSTRACT

The failure of compressors due to their most common causes of failure are avoided by monitoring the operation of a compressor and operating or locking off the compressor where appropriate. Specifically, the system in run after a predetermined number of pump-downs without a call for cooling and the compressor is locked off if it cycles a predetermined number of times within a preset time period or if a low pressure situation is sensed during a call for cooling.

11 Claims, 2 Drawing Sheets

METHOD AND APPARATUS FOR PREVENTING COMPRESSOR FAILURE DUE TO LOSS OF LUBRICANT

BACKGROUND OF THE INVENTION

During compressor shutdown, refriqerant accumulation and absorption takes place in the oil sump or crankcase and thereby dilutes the lubricating oil resulting in a refrigerant and oil mixture. The refrigerant accumulates in the compressor because it is at the lowest point in the system, due to the thermal gradient in the system and because of the affinity of halocarbon refrigerants for oil. Under normal operating conditions, some oil circulates with the refrigerant and will be returned to the compressor sump during continuous operation. In the case of a low side oil sump, there is a violent foaming that takes place upon start up due to the reduction of pressure and this produces a high oil circulation rate at this time.

Low concentrations of refrigerant in the compressor oil at start up is essential for long compressor and motor life, and satisfactory operation. The compressor is isolated from the system at shutdown through the compressor discharge valve at the outlet of the cylinder and a solenoid valve in the liquid line. Refrigerant is pumped out of the low side of the system at shutdown. A single pump out by closing the liquid line solenoid valve at shutdown may be used or the pump-down may be repeated automatically during shutdown as low side pressure rises. Repeated or continuous pump-down can cause a significant pumping of oil which is not returning to the compressor because of the short pumping cycle. To prevent the pumping out of all the oil, an oil safety switch is often employed to disable the compressor if there is an insufficient amount of oil. The use of an oil safety switch does not provide a complete solution since it must be bypassed on start up and when the system changes pressures.

Also, they are unreliable in the sense that they are subject to nuisance shutdowns, and expensive.

There are a number of situations where compressor operation will take place as a series of short cycles with the potential for causing the pumping out of the oil from the compressor. First, where there is a system refrigerant leak and a partial loss of the refrigerant charge there will be a repeated opening of the low pressure switch with a restart or reset since the thermostat will remain unsatisfied. Second, where the system is idle for an extended time but there is a periodic pump-down to keep the compressor dry. Third, where there is a valve leak and the compressor rapid cycles to keep the compressor dry.

SUMMARY OF THE INVENTION

In a refrigeration system which uses a low pressure switch as an operational control to energize the compressor contactor in a continuous pump-down application but which does not employ an oil safety switch, it is desirable to protect against oil loss. An oil loss can occur due to failure in another mode or from being idle for a long period of time whereby oil is pumped out of the compressor.

It is an object of this invention to provide a method and apparatus to prevent compressor failure due to the most common events which result in pumping oil out of a compressor.

It is a further object of this invention to provide a system which reacts to repeated short cycles of a compressor.

It is an additional object of this invention to permit continuous pump-down while protecting a compressor from the primary events which cause oil loss. These objects, and others as will become apparent hereinafter, are accomplished by the present invention.

Basically, in a refrigeration system with a microprocessor based control, the compressor is locked out or the system is run for a sufficient amount of time depending upon which is a appropriate remedy for the sensed condition.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
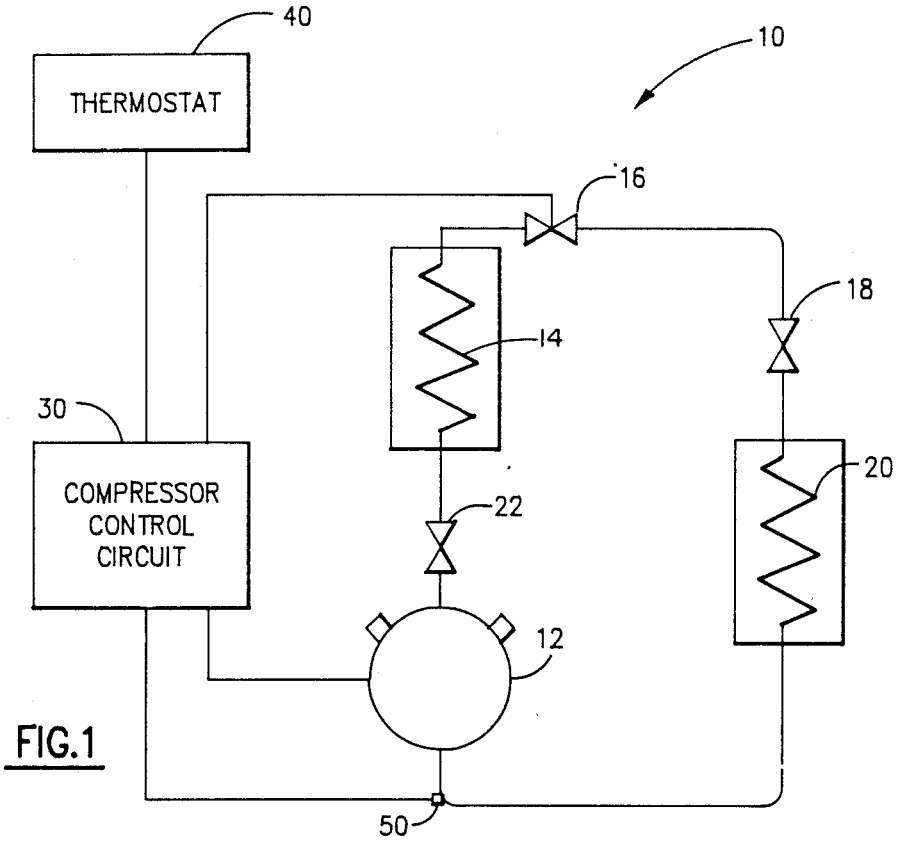
FIG. 1 is a schematic diagram of a refrigeration system.

In FIG. 1, the number 10 generally designates a refrigeration system having a refrigerant circuit serially including the four basic elements which are, namely, compressor 12, condenser 14, thermal expansion device 18 and evaporator 20. Additionally, a liquid line solenoid valve 16 is located in the refrigerant line intermediate condenser 14 and thermal expansion device 18 and a check valve 22 is located in the discharge line intermediate compressor 12 and condenser 14. It should be noted that check valve 22 is distinct from and located downstream of the discharge reed valves (not illustrated) of compressor 12 and its presence is preferred although the reed valves serve a check valve function. When the refrigeration system 10 is not in operation, the liquid line solenoid valve 16 and check valve 22 are intended to isolate the liquid refrigerant in the condenser 14. The operation of compressor 12, and thereby system 10, is responsive to thermostat 40 through compressor control circuit 30 which includes a microprocessor (not illustrated) and is operatively connected to compressor 12 and liquid line solenoid valve 16 as well as compressor protection devices such as low pressure sensor 50 which is responsive to the pressure of the refrigerant being supplied to compressor 12.

In operation of the refrigeration system 10, the compressor 12 delivers refrigerant gas at a high temperature and pressure to condenser 14 where the refrigerant gives up heat and condenses. The liquid refrigerant passes through open liquid line solenoid valve 16 to the thermal expansion device 18. The liquid refrigerant passing through the thermal expansion device is partially flashed and passes to the evaporator 20 where the remaining liquid refrigerant takes up heat and evaporates. The gaseous refrigerant returns to the compressor 12 to complete the cycle. If there is a low pressure in the return line to compressor 12 the compressor 12 will be disabled by compressor control circuit 30 responsive to the low pressure sensed by low pressure sensor 50.

When the compressor 12 is not running, liquid line solenoid 16 will be unpowered and closed and will coact with check valve 22, if present, or the discharge reed valves, to isolate liquid refrigerant in the condenser.

Figure 2:
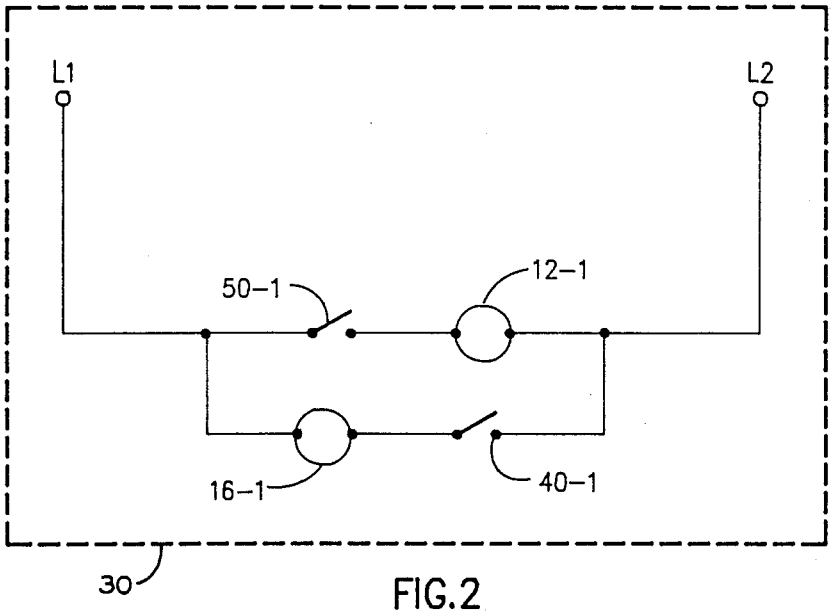
FIG. 2 is a schematic diagram of the electrical circuit for controlling the FIG. 1 system.

With reference to FIG. 2, when thermostat 40 calls for cooling its contacts 40-1 close thereby completing an electrical circuit between leads $L_1$ and $L_2$ with the solenoid coil 16-1 of normally closed solenoid valve 16 causing the energization of the solenoid coil 16-1 and the opening of liquid line solenoid valve 16. With valve 16 open, the liquid refrigerant is no longer trapped in the condenser 14 and there is an increase in the pressure in the system 10 and the contacts 50-1 of low pressure sensor 50 close. With the contacts of low pressure sensor 50 closed, the compressor contactor 12-1 is energized and compressor 12 runs.

When the thermostat 40 is satisfied its contacts 40-1 open causing the deactivation of the coil 16-1 and the closing of liquid line solenoid valve 16. The compressor contactor 12-1 remains energized and the compressor 12 continues to run and pump out the portion of the system 10 downstream of liquid line solenoid valve 16. Compressor 12 continues to run until the system pressure sensed by low pressure sensor 50 falls sufficiently causing the opening of the contacts 50-1 of low pressure sensor 50 and thereby the stopping of the compressor 12.

The above-described system can be subject to failure due to the pumping out of the oil in compressor 12. Possible cause of such failure in a conventional system include:

I—System Refrigerant Leak

If there is a call for cooling, thermostat contacts 40-1 close thereby activating and opening liquid line solenoid valve !6. Compressor 12 short cycles due to the opening of the contacts 50-1 of the low pressure sensor 50. As described above, a short cycle pumps a relatively large amount of oil. Because thermostat contacts 40-1 remain closed, the solenoid coil 16-1 of liquid line solenoid valve 16 remains activated and the compressor 12 shorts cycles each time the contacts 50-1 of low pressure sensor 50 close. This can continue until the compressor 12 pumps out all of its oil and fails.

II—System Idle For An Extended Time

If system 10 is operated such that compressor 12 is run periodically in a short cycle with liquid line solenoid valve 16 closed so as to maintain the system dry, the compressor 12 can fail due to the pumping out of its oil if the system 10 is idle for an extended period of time relative to the periodic pumping out cycles.

III—Valve Leak

If either the check valve structure made up of the reed valve alone or in combination with check valve 22 or liquid line solenoid valve 16 leaks, the contacts 50-1 of low pressure switch 50 will close upon the build up of sufficient pressure thereby starting compressor 12 although liquid line solenoid valve 16 will remain closed. Depending upon the leakage rate, the compressor 12 will short cycle at a corresponding rate and pump out its oil.

To prevent the pumping out of the oil from compressor 12 due to short cycling, the status of the solenoid of liquid line solenoid valve 16 and low pressure sensor contacts 50-1 are sensed. If the solenoid coil 16-1 of liquid line solenoid valve 16 is activated meaning that thermostat 40 is calling for cooling, but the low pressure sensor contacts 50-1 are open, then the compressor 12 is locked off as there is inadequate refrigerant in the system and this is most often due to a leak. The number of compressor cycles is tracked. If there are X cycles, e.g. one hundred, of pump-down to keep the system dry without a call for cooling, then the solenoid coil 16-1 of liquid line solenoid valve 16 is activated for Y minutes, e.g. ten, in order to allow the oil to return to the compressor 12 with the refrigerant. The cycling without a call for cooling can be determined by the closing of contacts 40-1 or by timing the cycle lengths, e.g. less than two minutes. The frequency of the cycles is also tracked so that if there are more than R cycles, e.g. three, in S minutes, e.g. sixty, then the compressor is locked out since there is a leak in valve 16 or 22.

Figure 3:
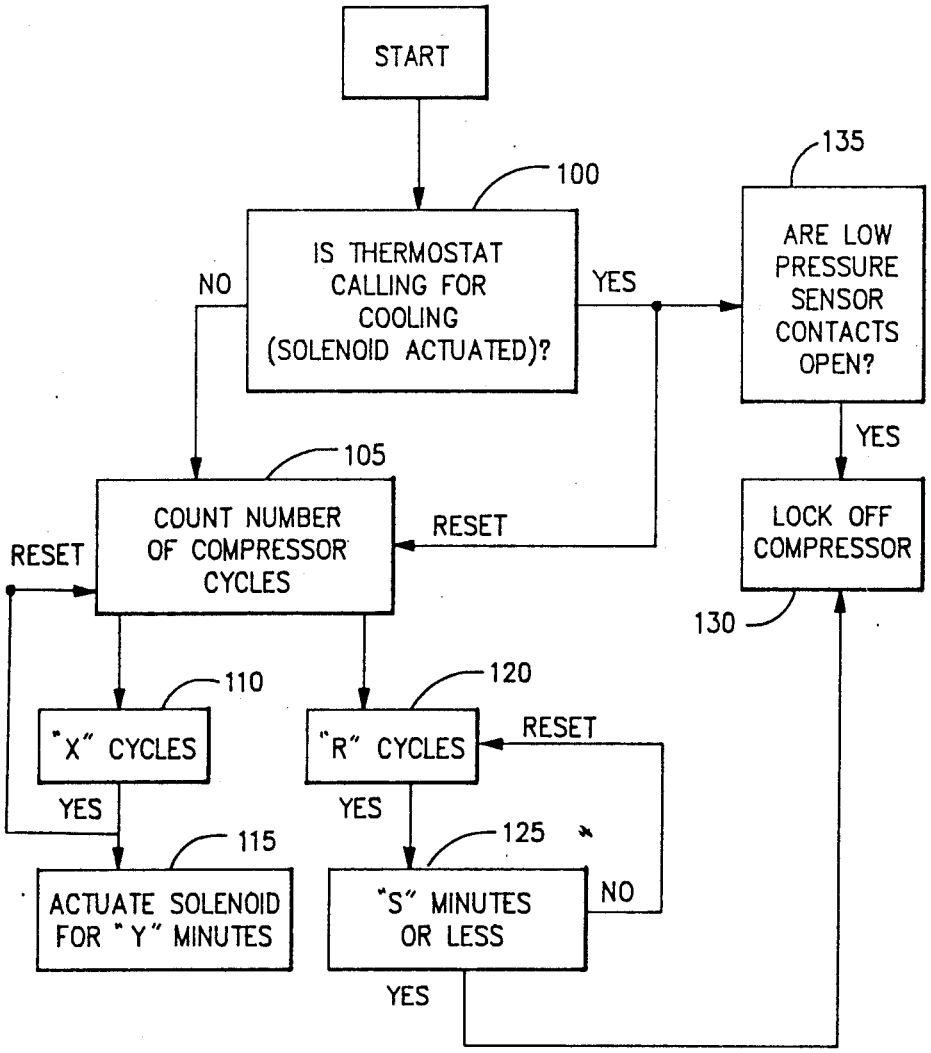
FIG. 3 is a flow chart showing the steps for detecting the primary causes of oil pump out and for shutting down the compressor to prevent failure due to the loss of lubrication.

The steps for monitoring the compressor activity to prevent the pumping out of the oil are shown in FIG. 3. As indicated by block 100, the initial determination is whether the thermostat 40 is calling for cooling which is the equivalent of determining whether the solenoid of coil 16-1 liquid line solenoid valve 16 is activated and valve 16 open. If thermostat 40 is not calling for cooling, then the number of compressor cycles is counted as indicated by block 105. If X cycles have been counted as indicated by block 110, then the liquid line solenoid valve 16 is opened for "Y" minutes as indicated by block 115 to permit the system to return the oil to compressor 12 since the opening of liquid line solenoid valve 16 will cause a pressure build up resulting in the closing of contacts 50-1 and the starting of compressor 12. Compressor 12 will continue to run until valve 16 closes and the system downstream of valve 16 is pumped down causing the opening of contacts 50-1 and the stopping of compressor 12. As indicated by block 120, R cycles are counted and the time period for the R cycles is determined as indicated in block 125 and if R cycles took place in S minutes or less, the compressor 12 is locked off as indicated by block 130 since there is an apparent valve leak. If R cycles took place in more than S minutes then the count of block 120 is reset by either eliminating the earliest cycle or by resetting to zero. If thermostat 40 is calling for cooling as indicated by block 100 then the compressor cycle count of block 105 is reset to zero and, as indicated by block 135, the position of the contacts 50-1 of pressure sensor 50 are determined. If contacts 50-1 are open then the compressor 12 is locked off as indicated by block 130 since there is an apparent system refrigerant leak.

Although a preferred embodiment has been illustrated and described, other modifications will occur to those skilled in the art. It is therefore intended that the present invention is to be limited only by the scope of the appended claims.

What is claimed is:

1. Apparatus for preventing compressor failure due to loss of lubricant in a refrigeration system operated responsive to a thermostat means and serially including compressor means, condenser means, thermal expansion means and an evaporator means comprising:

valve means located in said system intermediate said condenser means and said thermal expansion means;

means for sensing the pressure in said system at a point intermediate said evaporator means and said compressor means;

control circuit means including means for counting the number of compressor operating cycles;

said control circuit means being operatively connected to said thermostat means, said compressor means, said valve means and to said means for sensing whereby said compressor is locked off if said thermostat means is calling for cooling and said means for sensing senses too low of a pressure, and said valve means is opened for a predetermined time thereby causing operation of said compressor means if a predetermined number of compressor operating cycles have taken place without said thermostat means calling for cooling.

2. The apparatus of claim 1 wherein said control circuit means further includes means for timing the frequency of the compressor operating cycle whereby said compressor means is locked off if there is a predetermined number of compressor operating cycles within a predetermined time.

3. The apparatus of claim 1 wherein said valve means is a normally closed solenoid valve.

4. The apparatus of claim 1 further including check valve means located in said system intermediate said compressor means and said condenser means.

5. A method for preventing compressor failure due to loss of lubricant in a refrigeration system operated responsive to a thermostat means and serially including compressor means, condenser means, liquid line valve means, thermal expansion means and evaporator means comprising the steps of:

pumping down said compressor means at the end of each compressor operation cycle;

sensing the pressure at a point intermediate said evaporator means and said compressor means;

determining whether the compressor operation cycle was responsive to said thermostat means and, if not, determining whether a low pressure is being sensed;

if a low pressure is being sensed and the compressor operation cycle was not responsive to said thermostat means, locking out said compressor means.

6. The method of claim 5 further including the steps of;

counting the number of compressor operation cycles;

resetting the number of compressor cycles each time said thermostat means call for cooling;

each time a predetermined number of cycles has been counted, opening said liquid line valve means for a predetermined time period.

7. The method of claim 5 further including the steps of:

counting the number of compressor operation cycles;

timing the frequency of the compressor cycles; and locking out the compressor means if there are a predetermined number of compressor cycles within a predetermined number of compressor cycles within a predetermined time period.

8. The method of claim 6 further including the steps of:

timing the frequency of the compressor cycles; and locking out the compressor means if there are a predetermined number of compressor cycles within a predetermined time period.

9. A method for preventing compressor failure due to loss of lubricant in a refrigeration system operated responsive to a thermostat means and serially including compressor means, condenser means, liquid line valve means, thermal expansion means and evaporator means comprising the steps of:

pumping down said compressor means at the end of each compressor operation cycle;

counting the number of compressor operation cycles;

determining whether the compressor operation was responsive to said thermostat means and, if so, resetting the number of compressor cycles;

each time a predetermined number of cycles has been counted, opening said liquid line valve means for a predetermined time period.

10. The method of claim 9 further including the steps of timing the frequency of the compressor cycles; and locking out the compressor means if there are a predetermined number of compressor cycles within a predetermined time period.

11. A method for preventing compressor failure due to loss of lubricant in a refrigeration system operated responsive to a thermostat means and serially including compressor means, condenser means, liquid line valve means, thermal expansion means and evaporator means compressing the steps of:

pumping down said compressor means at the end of each compressor operation cycle;

counting the number of compressor operation cycles;

determining whether the compressor operation was responsive to said thermostat means and, if so, resetting the number of compressor cycles;

locking out the compressor means if there are a predetermined number of compressor cycles within a predetermined time period.

* * * * *